US005576156A

United States Patent [19]

Dickerson

[11] Patent Number: 5,576,156

[45] Date of Patent: Nov. 19, 1996

[54] LOW CROSSOVER RADIOGRAPHIC ELEMENTS CAPABLE OF BEING RAPIDLY PROCESSED

[75] Inventor: Robert E. Dickerson, Hamlin, N.Y.

[73] Assignee: Eastman Kodak Company, Rochester, N.Y.

[21] Appl. No.: 593,193

[22] Filed: Jan. 29, 1996

Related U.S. Application Data

[63] Continuation-in-part of Ser. No. 446,379, May 22, 1995.

[51] Int. Cl.[6] ..... G03C 1/46

[52] U.S. Cl. ..... 430/502; 430/496; 430/507; 430/517; 430/966

[58] Field of Search ..... 430/502, 507, 430/517, 966

[56] References Cited

U.S. PATENT DOCUMENTS

| | | | |
|---|---|---|---|
| 4,803,150 | 2/1989 | Dickerson et al. | 430/502 |
| 4,847,189 | 7/1989 | Suzuki et al. | 430/567 |
| 4,900,652 | 2/1990 | Dickerson et al. | 430/502 |
| 5,021,327 | 6/1991 | Bunch et al. | 430/496 |
| 5,147,769 | 9/1992 | Toyn et al. | 430/496 |
| 5,246,824 | 9/1993 | Delfino et al. | 430/502 |
| 5,399,470 | 3/1995 | Dickerson et al. | 430/509 |

*Primary Examiner*—Hoa Van Le
*Attorney, Agent, or Firm*—Carl O. Thomas

[57] ABSTRACT

A radiographic element is disclosed having emulsion layers coated on opposite surfaces of a transparent film support. To facilitate rapid processing the emulsion layers are fully forehardened and less than 35 mg/dm$^2$ of hydrophilic colloid is coated on each major surface. To reduce crossover and hydrophilic colloid, emulsions on the opposite sides of the support are each divided into two layers with the layer coated nearest the support containing a particulate dye capable of being decolorized during processing. Particulate dye and silver halide grains together account for between 30 and 70 percent of the total weight of the emulsion layers. Combined with the use of spectrally sensitized tabular grain emulsions crossover can be reduced to less than 15 percent while processing can be completed in less than 45 seconds. The distribution of hydrophilic colloid and silver halide grains chosen achieves low wet pressure sensitivity.

10 Claims, 1 Drawing Sheet

LOW CROSSOVER RADIOGRAPHIC ELEMENTS CAPABLE OF BEING RAPIDLY PROCESSED

This is a continuation-in-part of application Ser. No. 08/446,379, filed 22 May 1995.

FIELD OF THE INVENTION

The invention relates to radiographic elements containing radiation-sensitive silver halide emulsions adapted to be exposed by a pair of intensifying screens.

BACKGROUND

Dickerson et al U.S. Pat. No. 4,900,652 discloses a radiographic element which is capable of producing maximum densities in the range of from 3 to 4, exhibits reduced crossover and low wet pressure sensitivity, and can be fully processed in a rapid transport processor in less than 90 seconds. The radiographic element is comprised of a spectrally sensitized tabular grain emulsion layer on each opposite side of a transparent film support and processing solution decolorizable dye particles in hydrophilic colloid layers interposed between the emulsion layers and the support. Hydrophilic colloid on each side of the support is in the range of from 35 to 65 mg/dm$^2$, with the interposed layer containing hydrophilic colloid in the amount of at least 10 mg/dm$^2$.

Dickerson et al significantly advanced the state of the art. The spectrally sensitized tabular grain emulsion reduced crossover levels from 30 percent to approximately 20 percent. The dye particles further reduced crossover to less than 10 percent, with the capability of essentially eliminating crossover. The tabular grain emulsions also provided high covering power, allowing full forehardening and lower silver coverages to reach maximum image densities in the range of from 3 to 4. Dickerson et al discloses 35 mg/dm$^2$ of hydrophilic colloid on each major surface of the support to be the minimal amount compatible with achieving low wet pressure sensitivity.

PROBLEM TO BE SOLVED

While Dickerson et al represents an excellent radiographic film construction for just less than 90 second processing, the art is no longer satisfied with just less than 90 second processing. Instead, the current objective of the art is to complete processing in less than 45 seconds.

SUMMARY OF THE INVENTION

The present invention has as its purpose to provide a radiographic element that can provide the performance advantages of Dickerson et al and is capable of being processed in less than 30 seconds.

In one aspect this invention is directed to a radiographic element comprised of a film support having first and second major surfaces and capable of transmitting radiation to which the radiographic element is responsive and, coated on each of the major surfaces, processing solution permeable hydrophilic colloid layers which are fully forehardened including at least one emulsion comprised of silver halide grains coated at a coverage capable of providing an overall radiographic element maximum density on processing in the range of from 3 to 4, a spectral sensitizing dye adsorbed by the silver halide grains, and a particulate dye (a) capable of absorbing radiation to which the silver halide grains are responsive, (b) present in an amount sufficient to reduce crossover to less than 15 percent, and (c) capable of being substantially decolorized during processing, wherein from 19 to 33 mg/dm$^2$ of hydrophilic colloid is coated on each of the major surfaces of the support, first and second of the hydrophilic colloid layers are coated on each major surface of the support with the first layers located nearer the support than the second layers, the second layers contain (a) silver halide grains accounting for from 30 to 70 percent of the total weight of the second layers, including tabular grains having a thickness of less than 0.3 μm which have an average aspect ratio of greater than 5 and accounting for greater than 50 percent of total grain projected area within the second layers, and (b) from 20 to 80 percent of the total silver forming the silver halide grains within the radiographic element, the first layers contain (a) the dye particles and (b) from 20 to 80 percent of the total silver forming the silver halide grains within the radiographic element, and the dye particles and the silver halide grains together account for from 30 to 70 percent of the total weight of each of the first layers.

DESCRIPTION OF PREFERRED EMBODIMENTS

Figure 1:
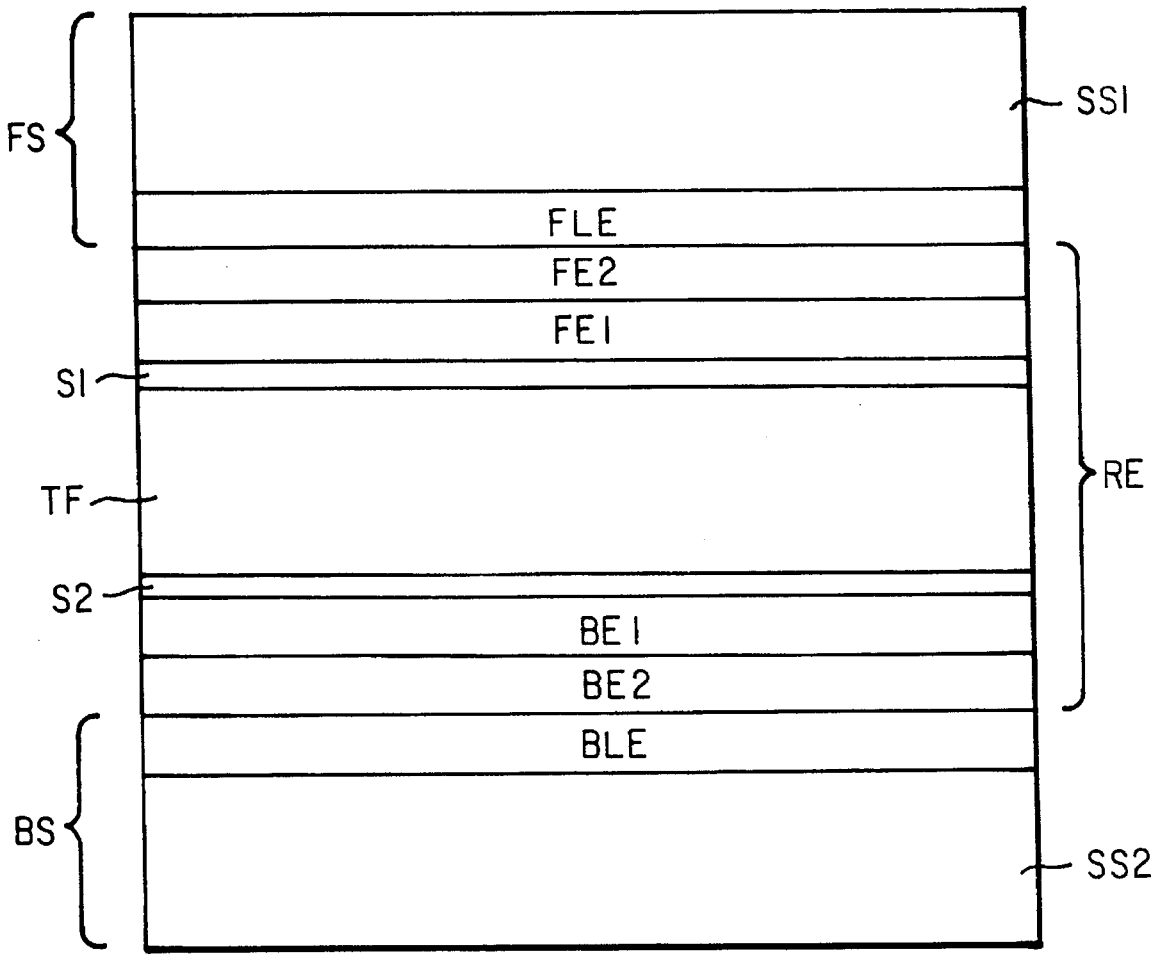
FIG. 1 is a schematic diagram of an assembly of a radiographic element according to the invention positioned between two intensifying screens.

In FIG. 1 an assembly is shown comprised of a radiographic element RE positioned between front and back intensifying screens FS and BS comprised of supports SS1 and SS2 and layers FLE and BLE that absorb X-radiation and emit light.

Located between the screens when intended to be imagewise exposed is radiographic element RE satisfying the requirements of the invention. The radiographic element is comprised of a transparent support TF, which is usually a transparent film support and is frequently blue tinted. To facilitate coating onto the support, subbing layers S1 and S2 are shown. Subbing layers are formed as an integral part of transparent film supports, but are not essential for all types of transparent supports. The transparent support and the subbing layers are all transparent to light emitted by the intensifying screens and are also processing solution impermeable. That is, they do not ingest water during processing and hence do not contribute to the "drying load"—the water that must be removed to obtain a dry imaged element.

First and second hydrophilic colloid layers FE1 and FE2, respectively, are coated on the major surface of the support positioned adjacent the front intensifying screen. Similarly, first and second hydrophilic colloid layers BE1 and BE2 are coated on the major surface of the support positioned adjacent the back intensifying screen. Also usually present, but not shown, are hydrophilic colloid layers, referred to as a surface overcoats, that overlie FE2 and BE2 and perform the function of physically protecting the underlying hydrophilic colloid layers during handling and processing. In addition to hydrophilic colloid the overcoats can contain matting agents, antistatic agents, lubricants and other non-imaging addenda.

The radiographic elements of the invention differ from those previously available in the art by offering a combination of advantageous characteristics never previously realized in a single radiographic element:

(1) Full forehardening.

(2) Maximum image densities in the range of from 3 to 4.

(3) Crossover of less than 15 percent.

(4) Processing in less than 45 seconds.

(5) Low wet pressure sensitivity.

(6) Relatively high levels of sensitivity.

While prior to the present invention the combination of characteristics (1)–(6) have been thought to impose incompatible construction requirements, by careful selection of components it has been possible for the first time to combine all of these characteristics in a single radiographic element.

The radiographic element RE is fully forehardened. This better protects the radiographic element from damage in handling and processing and simplifies processing by eliminating any necessity of completing hardening during processing.

As employed herein, the term "fully forehardened" means that the hydrophilic colloid layers are forehardened in an amount sufficient to reduce swelling of these layers to less than 300 percent, percent swelling being determined by (a) incubating the radiographic element at 38° C. for 3 days at 50 percent relative humidity, (b) measuring layer thickness, (c) immersing the radiographic element in distilled water at 21° C. for 3 minutes, and (d) determining the percent change in layer thickness as compared to the layer thickness measured in step (b).

Full forehardening is achieved by hardening the hydrophilic colloid layers. The levels of forehardening of a fully forehardened radiographic element are similar to those employed in forehardening photographic elements. A summary of vehicles for photographic elements, including hydrophilic colloids employed as peptizers and binders, and useful hardeners is contained in *Research Disclosure,* Vol. 365, September 1994, Item 36544, Section II. Vehicles, vehicle extenders, vehicle-like addenda and vehicle related addenda. *Research Disclosure* is published by Kenneth Mason Publications, Ltd., Dudley House, 12 North St., Emsworth, Hampshire P010 7DQ, England. Preferred vehicles for the hydrophilic colloid layers FE1, FE2, BE1 and BE2 as well as protective overcoats, if included, are gelatin (e.g., alkali-treated gelatin or acid-treated gelatin) and gelatin derivatives (e.g., acetylated gelatin or phthalated gelatin). Although conventional hardeners can be used more or less interchangeably with little or no impact on performance, particularly preferred are the bis(vinylsulfonyl) class of hardeners, such as bis(vinylsulfonyl)alkylether or bis(vinylsulfonyl)alkane hardeners, where the alkyl moiety contains from 1 to 4 carbon atoms.

For the radiographic element to be capable of forming an image, it must include at least one radiation-sensitive silver halide emulsion. The fully forehardened characteristic (1) restricts the choices of the silver halide emulsions in the following manner: It is well recognized in the art that silver image covering power can decline as a function of increased levels of forehardening. Covering power is expressed as image density divided by silver coating coverage. For example, Dickerson U.S. Pat. No. 4,414,304 defines covering power as 100 times the ratio of maximum density to developed silver, expressed in mg/dm$^2$. Dickerson recognized that tabular grain emulsions are less susceptible to covering power reduction with increasing levels of forehardening.

If the hydrophilic colloid layers are not fully forehardened, excessive water pick up during processing prevents processing in less than 45 seconds, characteristic (4). If tabular grain emulsions are not employed, excessive amounts of silver must be coated to realize characteristic (2), and characteristics (4) and (5) cannot be both realized. If the hydrophilic colloid is increased in proportion to the increase in silver, processing cannot be completed in less than 45 seconds. If silver is increased without increasing the hydrophilic colloid, the processed radiographic element will show localized density marks indicative of roller pressure applied in passing the exposed element through the processor, generally referred to as wet pressure sensitivity. Tabular grain emulsions frequently display higher levels of wet pressure sensitivity than nontabular grain emulsions.

With various other selections discussed below, all of characteristics (1)–(6) listed above can be realized by the incorporation of at least one tabular grain emulsion in the radiographic element RE. To be compatible with characteristics (1)–(6), the tabular grains of the emulsion having a thickness of less than 0.3 μm (preferably less than 0.2 μm) must have an average aspect ratio of greater than 5 (preferably greater than 8) and account for at least 50 percent (preferably at least 70 percent and, most preferably, at least 90 percent) of total grain projected area.

Although the thinnest obtainable tabular grains should be most effective, it is generally preferred that the tabular grains noted above have a thickness of at least 0.1 μm. Otherwise, the tabular grain emulsion will impart an undesirably warm image tone. Thus, for preferred radiographic element constructions there is a seventh characteristic to be taken into account:

(7) Relatively cold image tone.

Tabular grain silver halide emulsions contemplated for use in the practice of the invention can be of any of the following silver halide compositions: silver chloride, silver bromide, silver iodobromide, silver chlorobromide, silver bromochloride, silver iodochloride, silver iodochlorobromide and silver iodobromochloride, where the mixed halides are named in order of ascending concentrations. Since it is recognized that the presence of iodide slows grain development, it is advantageous to choose emulsions that contain no iodide or only limited levels of iodide. Iodide concentrations of less than 4 mole percent, based on silver, are specifically preferred. Of the three photographic halides (chloride, bromide and iodide), silver chloride has the highest solubility and hence lends itself to achieving the highest rates of development. It is therefore preferred in terms of achieving characteristic (4). When characteristics (4) and (6) are considered together, silver chlorobromide and silver bromide compositions are preferred.

Conventional high (greater than 50 mole percent) chloride tabular grain emulsions compatible with requirements of the radiographic elements of this invention are illustrated by the following citations:

Wey et al U.S. Pat. No. 4,414,306;

Maskasky U.S. Pat. No. 4,400,463;

Maskasky U.S. Pat. No. 4,713,323;

Takada et al U.S. Pat. No. 4,783,398;

Nishikawa et al U.S. Pat. No. 4,952,491;

Ishiguro et al U.S. Pat. No. 4,983,508;

Tufano et al U.S. Pat. No. 4,804,621;

Maskasky U.S. Pat. No. 5,061,617;

Maskasky U.S. Pat. No. 5,178,997;

Maskasky and Chang U.S. Pat. No. 5,178,998;

Maskasky U.S. Pat. No. 5,183,732;

Maskasky U.S. Pat. No. 5,185,239;

Maskasky U.S. Pat. No. 5,217,858;

Chang et al U.S. Pat. No. 5,252,452;

Maskasky U.S. Pat. No. 5,264,337;
Maskasky U.S. Pat. No. 5,272,052;
Maskasky U.S. Pat. No. 5,275,930;
Maskasky U.S. Pat. No. 5,292,632;
Maskasky U.S. Pat. No. 5,298,387;
Maskasky U.S. Pat. No. 5,298,388; and
House et al U.S. Pat. No. 5,320,938.

Conventional high (greater than 50 mole percent) bromide tabular grain emulsions compatible with requirements of the radiographic elements of this invention are illustrated by the following citations:

Abbott et al U.S. Pat. No. 4,425,425;
Abbott et al U.S. Pat. No. 4,425,426;
Kofron et al U.S. Pat. No. 4,439,520;
Maskasky U.S. Pat. No. 4,713,320;
Nottorf U.S. Pat. No. 4,722,886;
Saito et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Black et al U.S. Pat. No. 5,219,720;
Dickerson et al U.S. Pat. No. 5,252,443;
Tsaur et al U.S. Pat. No. 5,272,048;
Delton U.S. Pat. No. 5,310,644;
Chaffee et al U.S. Pat. No. 5,358,840; and
Delton U.S. Pat. No. 5,372,927.

The tabular grain emulsions useful in radiography are those that have an average equivalent circular diameter (ECD) of less than 10 μm. Typically the average ECD of the grains is 5 μm or less. The emulsions can be polydisperse or monodisperse, depending upon the specific imaging application contemplated. It is generally preferred that the coefficient of variation (COV) of grain ECD be less than 25 percent. For high contrast imaging, a COV of less than 10 percent is contemplated. COV is defined as the standard deviation of grain ECD divided by average ECD.

When tabular grain emulsions satisfying the requirements set forth above are employed, total silver coating coverages in the range of from 35 to 60 mg/dm$^2$ are capable upon processing of producing a silver image having a maximum density in the range of from 3 to 4.

It is contemplated to incorporate at least one tabular grain emulsion of the type described above in each of hydrophilic colloid layers FE2 and BE2.

If all of the radiation silver halide grains contained in the radiographic element were restricted to just layers FE2 and BE2, spectrally sensitizing tabular grain emulsions to be incorporated in these layers is capable of itself reducing crossover to just less than 20 percent, as illustrated by Abbott et al U.S. Pat. Nos. 4,425,425 and 4,425,426 (hereinafter referred to collectively as Abbott et al).

All references to crossover percentages are based on the crossover measurement technique described in Abbott et al, here incorporated by reference. The crossover of a radiographic element according to the invention under the contemplated conditions of exposure and processing can be determined by substituting a black object (e.g., kraft paper) for one of the two intensifying screens. To provide a verifiable standard for measuring percent crossover, the exposure and processing described in the Examples, below, should be employed. Exposure through a stepped density test object exposes primarily the emulsion on the side of the radiographic element nearest the intensifying screen, but the emulsion on the side of the radiographic element farthest from the intensifying screen is also exposed, but to a more limited extent by unabsorbed light passing through the support. By removing emulsion from the side of the support nearest the intensifying screen in one sample and the side of the support farther from the intensifying screen in another sample, a characteristic curve (density vs. log E, where E is the light passing through the stepped test object, measured in lux-seconds) can be plotted for each emulsion remaining. The characteristic curve of the emulsion on the side farthest from the substituted light source is laterally displaced as compared to the characteristic curve of the emulsion on the side nearest the substituted light source. An average displacement (Alog E, where E is exposure in lux-seconds) is determined and used to calculate percent crossover as follows:

$$\text{Percent Crossover} = \frac{1}{\text{antilog}(\Delta\log E)} \times 100 \qquad \text{(I)}$$

If screen emission is in the spectral region to which silver halide possesses native sensitivity, then the silver halide grains themselves contribute to light absorption and therefore crossover reduction. This occurs to a significant extent only at exposure wavelengths of less than 425 nm. Spectral sensitizing dye adsorbed to the grain surfaces is primarily relied upon for absorption of light emitted by the screens. The silver halide emulsions can contain any conventional spectral sensitizing dye or dye combination adsorbed to the grain surfaces. Typically dye absorption maxima are closely matched to the emission maxima of the screens so that maximum light capture efficiency is realized. To maximize speed (6) and minimize crossover (3), it is preferred to adsorb dye to the grain surfaces in a substantially optimum amount—that is, in an amount sufficient to realize at least 60 percent of maximum speed under the contemplated conditions of exposure and processing. To provide an objective standard for reference the conditions of exposure and processing set out in the Examples below can be employed. Illustrations of spectral sensitizing dyes useful with the radiographic elements of the invention are provided by Kofron et al U.S. Pat. No. 4,439,520, here incorporated by reference, particularly cited for its listing of blue spectral sensitizing dyes. Abbott et al U.S. Pat. Nos. 4,425,425 and 4,425,426 also illustrate the use of spectral sensitizing dyes to reduce crossover. A more general summary of spectral sensitizing dyes is provided by *Research Disclosure,* Item 36544, cited above, Section V. Spectral sensitization and desensitization, A. Sensitizing dyes.

To reduce crossover to less than 15 percent and, preferably, to less than 10 percent it is contemplated to introduce additional dye capable of absorbing within the wavelength region of exposure into the hydrophilic colloid layers FE1 and BE1. The additional dye is chosen to absorb exposing light that is not absorbed by the silver halide grains and spectral sensitizing dye contained in hydrophilic colloid layers FE2 and BE2. If the additional dye is incorporated into the hydrophilic colloid layers FE2 and BE2 as well, the result is a marked reduction in photographic speed.

In addition to its absorption properties the additional dye is chosen to impart still another characteristic to the radiographic element:

(8) Decolorization during processing.

Dickerson et al U.S. Pat. Nos. 4,803,150 and 4,900,652, here incorporated by reference, disclose particulate dyes capable of (a) absorbing radiation to which the silver halide grains are responsive to reduce crossover to less than 15 percent and (b) being substantially decolorized during processing. The particulate dyes can, in fact, substantially eliminate crossover. The mean ECD of the dye particles can range up to 10 μm, but is preferably less than 1 μm. Dye particle sizes down to about 0.01 μm can be conveniently formed. Where the dyes are initially crystallized in larger than desired particle sizes, conventional techniques for achieving smaller particle sizes can be employed, such as ball milling, roller milling, sand milling, and the like.

Since the hydrophilic colloid layers are typically coated as aqueous solutions in the pH range of from 5 to 6, most typically from 5.5 to 6.0, the dyes are selected to remain in particulate form at those pH levels in aqueous solutions. The dyes must, however, be readily soluble at the alkaline pH levels employed in photographic development. Dyes satisfying these requirements are nonionic in the pH range of coating, but ionic under the alkaline pH levels of processing. Preferred dyes are nonionic polymethine dyes, which include the merocyanine, oxonol, hemioxonol, styryl and arylidene dyes. In preferred forms the dyes contain carboxylic acid substituents, since these substituents are nonionic in the pH ranges of coating, but are ionic under alkaline processing conditions.

Specific examples of particulate dyes are described by Lemahieu et al U.S. Pat. No. 4,092,168, Diehl et al WO 88/04795 and EPO 0 274 723, and Factor et al EPO 0 299 435, Factor et al U.S. Pat. No. 4,900,653, Diehl et al U.S. Pat. No. 4,940,654 (dyes with groups having ionizable protons other than carboxy), Factor et al U.S. Pat. No. 4,948,718 (with arylpyrazolone nucleus), Diehl et al U.S. Pat. No. 4,950,586, Anderson et al U.S. Pat. No. 4,988,611 (particles of particular size ranges and substituent pKa values), Diehl et al U.S. Pat. No. 4,994,356, Usagawa et al U.S. Pat. No. 5,208,137, Adachi U.S. Pat. No. 5,213,957 (merocyanines), Usami U.S. Pat. No. 5,238,798 (pyrazolone oxonols), Usami et al U.S. Pat. No. 5,238,799 (pyrazolone oxonols), Diehl et al U.S. Pat. No. 5,213,956 (tricyanopropenes and others), Inagaki et al U.S. Pat. No. 5,075,205, Otp et al U.S. Pat. No. 5,098,818, Texter U.S. Pat. No. 5,274,109, McManus et al U.S. Pat. No. 5,098,820, Inagaki et al EPO 0 385 461, Fujita et al EPO 0 423 693, Usui EPO 0 423 742 (containing groups with specific pKa values), Usagawa et al EPO 0 434 413 (pyrazolones with particular sulfamoyl, carboxyl and similar substituents), Jimbo et al EPO 0 460 550, Diehl et al EPO 0 524 593 (having alkoxy or cyclic ether substituted phenyl substituents), Diehl et al EPO 0 524 594 (furan substituents) and Ohno EPO 0 552 646 (oxonols).

If all of the silver halide required for imaging is located in the hydrophilic colloid layers FE2 and BE2, it is impossible satisfy characteristics (4) and (5). If hydrophilic colloid is reduced to less than 35 mg/dm$^2$ per side, processing in less than 45 seconds (4) can be realized, but high levels of wet pressure sensitivity are observed. Wet pressure sensitivity is observed as uneven optical densities in the fully processed image, attributable to differences in guide roller pressures applied in rapid processing. If the amount of hydrophilic colloid in the layers FE2 and BE2 is increased to an extent necessary to eliminate visible wet pressure sensitivity, the radiographic element cannot be processed in less than 45 seconds.

It has been discovered that successful rapid processing and low levels of wet pressure sensitivity can be both realized if a portion of the spectrally sensitized radiation-sensitive silver halide relied upon for imaging is incorporated in the hydrophilic colloid layers FE1 and BE1. Surprisingly, as demonstrated in the Examples below, when a portion of the spectrally sensitized radiation-sensitive silver halide is coated in the hydrophilic colloid layers containing the particulate dye used for crossover reduction, fully acceptable photographic speeds can still be maintained. This is in direct contradiction to observations that particulate dye and silver halide emulsion blending in a single hydrophilic colloid result in unacceptably low levels of photographic speed. By incorporating both a portion of the silver halide emulsion and the particulate dye in hydrophilic colloid layers FE1 and BE1, it is possible to reduce the total coverage of hydrophilic colloid per side of the radiographic elements of the invention to less than 33 mg/dm$^2$ while satisfying characteristics (1)–(6). All of characteristics (1)–(6) can be realized when the total coverage of hydrophilic colloid per side is in the range of from 25 to 33 mg/dm$^2$, optimally 30 to 33 mg/dm$^2$. With a significant, but tolerable increase in wet pressure total coverage of hydrophilic colloid per side can be reduced to 19 mg/dm$^2$. In preferred forms of the invention, the low levels of hydrophilic colloid per side allow processing characteristic (4) to be reduced to less than 35 seconds.

The silver halide emulsion incorporated in the hydrophilic colloid layers FE1 and BE1 can be a portion of the same tabular grain emulsion or emulsions incorporated in hydrophilic colloid layers FE2 and BE2. However, it is recognized that layers FE1 and BE1 can contain any conventional radiographic silver halide emulsion. For example, the emulsion can satisfy the criteria provided above for selection of tabular grain emulsions, except that the grains need not be confined to those having tabular shapes. Conventional silver halide emulsions are summarized in *Research Disclosure* Item 36544, cited above, I. Emulsion grains and their preparation, and in *Research Disclosure,* Vol. 184, August 1979, Item 18431, Radiographic films/materials 1. Silver halide emulsions.

To satisfy characteristics (1)–(6), from 20 to 80 (preferably 30 to 70) percent of the total silver forming the radiographic element must be contained in the hydrophilic colloid layers FE2 and BE2. Similarly, from 20 to 80 (preferably 30 to 70) percent of the total silver forming the radiographic element must be contained in the hydrophilic colloid layers FE1 and BE1. It is generally preferred that at least 50 percent of the total silver forming the radiographic element be contained in the hydrophilic colloid layers FE2 and BE2.

In addition, to satisfy characteristics (1)–(6), the silver halide grains in hydrophilic colloid layers FE2 and BE2 account for from 30 to 70 (preferably 40 to 60) percent of the total weight of these layers. Similarly, in hydrophilic colloid layers FE1 and BE1 the silver halide grains and dye particles together account for from 30 to 70 (preferably 40 to 60) percent of the total weight of these layers.

In one form the radiographic element RE is symmetrically constructed. That is, hydrophilic colloid layers FE1 and BE1 are identical while hydrophilic colloid layers FEZ and BE2 are also identical.

It has been recognized that low crossover radiographic elements intended to be employed for medical diagnostics can advantageously be asymmetrically constructed. Bunch et al U.S. Pat. No. 5,021,327, the disclosure of which is here incorporated by reference, discloses that asymmetrical photicity, a photicity by the back intensifying screen and emulsion layer or layers it exposes being at least twice that of the front intensifying screen and emulsion layer or layers it exposes, can be realized by employing symmetrical radiographic elements with asymmetrical screens, by employing asymmetrical radiographic elements with symmetrical screens, or by employing both asymmetrical screens and asymmetrical radiographic elements. Bunch et al defines photicity as the integrated product of (a) the total emission of the screen over the wavelength range to which the emulsion layer(s) is responsive, (b) the sensitivity of the emulsion layer(s) over this emission range, and (3) the transmittance of radiation between the screen and the emulsion layer(s) it exposes. Since transmitance is almost always near unity, photicity then is the combination of screen emission and the sensitivity of the emulsion layer(s) it exposes. Bunch et al contemplates photicities by the back screen and the emulsion layer(s) it exposes to be 2 to 10 times those of the front screen and the emulsion layer(s) it exposes. In implementing the teachings of Bunch et al employing the radiographic element RE the photicity of the combination of BLE and BE1 and BE2 is from 2 to 10 times that of the photicity of the combination of FLE and FE1 and FE2. Bunch et al also places a minimum modulation transfer function (MTF) requirement on the front intensifying screen.

Dickerson et al U.S. Pat. No. 4,994,355, the disclosure of which is here incorporated by reference, discloses that a single radiographic image can provide useful lung (i.e., low X-ray absorption anatomy) and heart (i.e., high X-ray absorption anatomy) images when a low crossover radiographic is constructed with the emulsion layer or layers on one side of the support exhibit an average contrast of less than 2.0 over the density range of from 0.25 to 2.0 and the emulsion layer or layers on the opposite side of the support exhibit an average contrast of at least 2.5 over the same density range. Contrast measurements are based on symmetrical film samples so that the contrast reported for a single side coating can be better referenced to conventional contrast values in symmetrical radiographic elements. In applying the teachings of Dickerson et al to the radiographic element RE it is recognized that FE1 and FE2 can together provide an average contrast of at least 2.5 while BE1 and BE2 together provide an average contrast of less than 2.0 or the average front and back average contrasts can be reversed.

Unrecognized and untaught by Dickerson et al U.S. Pat. No. 4,994,355, it is also possible to choose the emulsions so that FE1 and BE1 together provide one of the average contrasts (preferably an average contrast of less than 2.0) while FE2 and BE2 together provide the remaining average contrast (preferably an average contrast of at least 2.5). The advantage to be realized is that the resulting radiographic element offers the diagnostic advantages of Dickerson et al U.S. Pat. No. 4,994,355, but does not require an asymmetrical film construction. Thus, the burden of properly orienting an asymmetrical radiographic element in the exposure cassette is eliminated.

Dickerson et al U.S. Pat. No. 4,997,570, the disclosure of which is here incorporated by reference, demonstrates that in a low crossover radiographic element a variety of different image contrasts can be obtained by using different front and back intensifying screens when the one of the front and back emulsion layer unit exhibits at least twice the speed of the remaining emulsion layer unit. In applying the teachings of Dickerson et al to the radiographic element RE, it is contemplated that the emulsion layers FE1 and FE2 can together exhibit a speed at least twice that of emulsion layers BE1 and BE2.

Dickerson et al U.S. Pat. No. 5,108,881, the disclosure of which is here incorporated by reference, discloses a low crossover radiographic element in which lower contrast emulsion layer(s) on one side of the support exhibit over an exposure range of at least 1.0 log E (where E is exposure in lux-seconds), an average contrast of from 0.5 to <2.0, and point gammas that differ from the average contrast by less than ±40% while higher contrast emulsion layer(s) on the opposite side of the support exhibit a mid-scale contrast that is at least 0.5 higher than the average contrast of the emulsion layer(s) on the one side of the support. Again contrasts for the emulsions on each side of the radiographic element are based on measurements obtained by symmetrical coatings on both sides of the support to facilitate comparison with conventional symmetrical radiographic elements. In a preferred construction the lower contrast emulsion layer(s) exhibit a higher photographic speed than the lower contrast emulsion layer(s).

In applying the teachings of Dickerson et al U.S. Pat. No. 5,108,881 to the radiographic element RE it is contemplated to employ FE1 and FE2 together to provide the function of one of the lower and higher contrast emulsion layer(s) and to employ BE1 and BE2 together to provide the function of the remaining of the lower and higher contrast emulsion layer(s). Alternatively, FE1 and BE1 can together provide the function of one of the lower and higher contrast emulsion layer(s) and FE2 and BE2 can together provide the function of the remaining of the lower and higher contrast emulsion layer(s).

Specific selections of remaining features of the radiographic element RE can take any convenient conventional form compatible with the descriptions provided. For example, transparent film supports and the subbing layers that are typically provided on their major surfaces to improve the adhesion of hydrophilic colloid layers are disclosed in *Research Disclosure* Item 36544, Section XV. Supports and in *Research Disclosure* Item 18431, Section XII. Film Supports. Chemical sensitization of the emulsions is disclosed in *Research Disclosure* Item 36544, Section IV. Chemical sensitization and *Research Disclosure* Item 18431, Section I.C. Chemical Sensitization/Doped Crystals. The chemical sensitization of tabular grain emulsions is more particularly taught in Kofron et al U.S. Pat. No. 4,429,520, here incorporated by reference.

The following sections of *Research Disclosure* Item 18431 summarize additional features that are applicable to the radiographic elements of the invention:

II. Emulsion Stabilizers, Antifoggants and Antikinking Agents

III. Antistatic Agents/Layers

IV. Overcoat Layers

The following sections of *Research Disclosure* Item 36544 summarize additional features that are applicable to the radiographic elements of the invention:

VII. Antifoggants and stabilizers

IX. Coating physical property modifying addenda

EXAMPLES

The invention can be better appreciated by consideration in connection with the following specific embodiments. The letters C and E are appended to element numbers to differentiate control and example radiographic elements. All coating coverages are in mg/dm$^2$, except as otherwise indicated.

ELEMENT 1C

A radiographic element was constructed by coating onto both major faces a blue tinted 7 mil (178 μm) poly(ethylene terephthalate) film support (S) an emulsion layer (EL), an interlayer (IL) and a transparent surface overcoat (SOC), as indicated:

| |
|---|
| SOC |
| IL |
| EL |
| S |
| EL |
| IL |
| SOC |

| Emulsion Layer (EL) | |
|---|---|
| Contents | Coverage |
| Ag | 25.8 |
| Gelatin | 26.2 |
| 4-Hydroxy-6-methyl-1,3,3a,7-tetraazaindene | 2.1 mg/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Bis(vinylsulfonyl)ether (based on wt. of gelatin) | 2.5% |
| **Interlayer (IL)** | |
| Gelatin | 3.4 |
| AgI Lippmann | 0.11 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| **Surface Overcoat (SOC)** | |
| Gelatin | 3.4 |
| Poly(methyl methacrylate) matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

The Ag in EL was provided in the form a thin, high aspect ratio tabular grain silver bromide emulsion in which the tabular grains accounted for greater than 90 percent of total grain projected area, exhibited an average equivalent circular diameter (ECD) of 1.8 μm, an average thickness of 0.13, and an average aspect ratio of 13.8. The AgI Lippmann emulsion present in IL exhibited a mean ECD of 0.08 μm.

ELEMENT 2C

Element 2C was constructed identically to Element 1C, except that a crossover control layer (CCL) was interposed between each emulsion layer (EL) and the support (S). Each CCL layer contained gelatin and a crossover control (XOC) dye and was constructed as follows:

| Crossover Control Layer (CCL) | |
|---|---|
| Contents | Coverage |
| 1-(4'-Carboxyphenyl)-4-(4'-dimethylaminobenzylidene)-3-ethoxycarbonyl-2-pyrazolin-5-one (Dye XOC-1) | 0.55 |
| Gelatin | 16.3 |

The crossover control dye was coated in the form of particles have a mean diameter of less than 1 μm.

Element 3C

Element 3C was identical to Element 2C, except that the coating coverage of Dye XOC-1 was increased to 1.1.

Element 4C

Element 4C was identical to Element 2C, except that the coating coverage of Dye XOC-1 was increased to 2.2.

Element 5C

Element 5C was identical to Element 1C, except that Dye XOC-1 at a coverage of 0.55 was blended into each emulsion layer (EL).

Element 6C

Element 6C was identical to Element 1C, except that Dye XOC-1 at a coverage of 1.1 was blended into each emulsion layer (EL).

Element 7C

Element 7C was identical to Element 1C, except that Dye XOC-1 at a coverage of 2.2 was blended into each emulsion layer (EL).

Element 8E

Element 8E was identical to Element 1C, except that each emulsion layer (EL) was divided into a pair of emulsion layers, an upper emulsion layer (UEL) and a lower emulsion layer (LEL) that were identical, except that the emulsion layer in each pair coated nearer the support (LEL) contained Dye XOC-1 at a coverage of 0.55.

| |
|---|
| SOC |
| IL |
| UEL |
| LEL |
| S |
| LEL |
| UEL |
| IL |
| SOC |

Element 9E

Element 9E was identical to Element 8E, except that the coverage of Dye XOC-1 was increased to from 0.55 to 1.1.

Element 10E

Element 9E was identical to Element 8E, except that the coverage of Dye XOC-1 was increased to from 0.55 to 2.2.

Element 11C

Element 11C was identical to Element 1C, except that the gelatin in the emulsion layer was reduced to 14.0 mg/dm$^2$, the gelatin in the interlayer was reduced to 2.7 mg/dm$^2$, and the gelatin in the surface overcoat was reduced to 2.7 mg/dm$^2$, for a total gelatin coverage per side of 19.4 mg/dm$^2$.

Element 12E

Element 12E was identical to Element 8E, except that the gelatin in the amount of 7.0 mg/dm$^2$ was used in both the upper and lower emulsion layers (UEL and LEL), the gelatin in the interlayer was reduced to 2.7 mg/dm$^2$, and the gelatin in the surface overcoat was reduced to 2.7 mg/dm$^2$, for a total gelatin coverage per side of 19.4 mg/dm$^2$.

Element 13E

Element 13E was identical to Element 12E, except that the coverage of Dye XOC-1 was increased from 0.55 to 1.1 mg/dm$^2$.

Element 14E

Element 14E was identical to Element 13E, except that the coverage of Dye XOC-1 was increased from 1.1 to 2.2 mg/dm$^2$.

EVALUATIONS

To determine speed, contrast and minimum density, samples of the elements were simultaneously exposed on each side for 1/50 sec through a graduated density step tablet using a MacBeth™ sensitometer having a 500 watt General Electric DMX™ projector lamp calibrated to 2650° K. and filtered through a Corning C4010™ filter (480–600 nm, 530 nm peak transmission).

The exposed elements were processed using a Kodak X-Omat RA 480 processor set for the following processing cycle:

| | |
|---|---|
| Development | 11.1 seconds at 40° C. |
| Fixing | 9.4 seconds at 30° C. |
| Washing | 7.6 seconds at room temperature |
| Drying | 12.2 seconds at 67.5° C. |
| The following developer was employed, components are expressed in g/L, except as indicated: | |
| Hydroquinone | 32 |
| 4-Hydroxymethyl-4-methyl-1-phenyl-3-pyrazolidinone | 6 |
| Potassium bromide | 2.25 |
| 5-Methylbenzotriazole | 0.125 |
| Sodium sulfite | 160 |
| Water to 1 liter | |
| pH 10 | |

From processed samples of the radiographic elements characteristic curves were constructed using optical densities expressed in terms of diffuse density as measured by an X-rite Model 310™ densitometer, which was calibrated to ANSI standard PH 2.19 and traceable to a National Bureau of Standards calibration step tablet.

The speed, contrast and minimum density (Dmin) obtained by these measurements are summarized in Table I. Speed was measured at a density of 1.0 above minimum density (Dmin). Speed is reported in relative log speed units—e.g., a speed difference of 30 relative speed units equals a speed difference of 0.3 log E, where E is measured lux-seconds.

Dye stain was measured as the difference between density at 505 nm, the peak absorption wavelength of Dye XOC-1, and 440 nm. Since silver exhibits essentially the same density at both of these wavelengths, subtraction of the 440 nm density from the 505 nm density provides a measure of dye stain. Densities were measured in samples that were processed as described above, but were not exposed. Hence, the only silver present was that corresponding to Dmin.

To compare the ability of the processor to dry the film samples, samples of the Elements were flash exposed to provide a density of 1.0 when processed. As each film sample started to exit the processor, the processor was stopped, and the sample was removed from the processor. Roller marks were visible on the film in areas that had not dried. A film that was not dry as it left the processor was assigned a % dryer value of 100+. A film that exhibited roller marks from first encountered guide rollers, but not the later encountered guide rollers, indicating that the film had already dried when passing over the latter rollers, was assigned a % dryer value indicative of percentage of the rollers that were guiding undried portions of the film. Hence lower % dryer values indicate quicker drying film samples.

To permit crossover determinations samples of the Elements were exposed with a Lanex Regular™ green emitting intensifying screen in contact with one side of the sample and black kraft paper in contact with the other side of the sample. The X-radiation source was a Picker VGX653 3-phase X-ray machine, with a Dunlee High-Speed PX1431-CQ-150 kVp 0.7/1.4 focus tube. Exposure was made at 70 kVp, 32 mAs, at a distance of 1.40 m. Filtration was with 3 mm Al equivalent (1.25 inherent+1.75 Al); Half Value Layer (HVL)-2.6 mmAl. A 26 step Al step wedge was used, differing in thickness by 2 mm per step.

Processing of these samples was undertaken as described above. By removing emulsion from the side of the support nearest the screen at some sample locations and from the side of the support opposite the screen at other sample locations the density produced on each side of the support at each step was determined. From this separate characteristic (density vs. log E) curves were plotted for each emulsion layer. The exposure offset between the curves was measured at three locations between the toe and shoulder portions of the curves and averaged to obtain Δlog E for use in equation (I), above.

The results summarized in Tables I and II demonstrate the advantages of the radiographic elements of the invention.

TABLE I

| Element | Gelatin per side | XOC Dye Coverage | XOC Dye Location | % Crossover | Speed | Contrast | Dmax | Dmin | Dye Stain | % Dryer |
|---|---|---|---|---|---|---|---|---|---|---|
| 1C | 32.6 | 0 | — | 22 | 100 | 3.1 | 3.8 | 0.27 | 0.04 | 80 |
| 2C | 48.9 | 0.55 | CCL | 12 | 87 | 2.9 | 3.5 | 0.26 | 0.06 | 100+ |
| 3C | 48.9 | 1.1 | CCL | 7 | 83 | 2.8 | 3.5 | 0.27 | 0.06 | 100+ |
| 4C | 48.9 | 2.2 | CCL | 4 | 82 | 2.7 | 3.5 | 0.26 | 0.06 | 100+ |
| 5C | 32.6 | 0.55 | EL | 15 | 70 | 3.1 | 3.8 | 0.25 | 0.04 | 90 |
| 6C | 32.6 | 1.1 | EL | 10 | 58 | 2.8 | 3.8 | 0.25 | 0.04 | 80 |
| 7C | 32.6 | 2.2 | EL | 5 | 41 | 2.4 | 3.6 | 0.24 | 0.04 | 85 |
| 8E | 32.6 | 0.55 | LEL | 12 | 74 | 3.1 | 4.0 | 0.26 | 0.04 | 80 |
| 9E | 32.6 | 1.1 | LEL | 8 | 68 | 2.8 | 3.7 | 0.25 | 0.04 | 80 |

TABLE I-continued

| Element | Gelatin per side | XOC Dye Coverage | XOC Dye Location | % Crossover | Speed | Contrast | Dmax | Dmin | Dye Stain | % Dryer |
|---|---|---|---|---|---|---|---|---|---|---|
| 10E | 32.6 | 2.2 | LEL | 3 | 61 | 2.4 | 3.7 | 0.24 | 0.04 | 80 |

TABLE II

| Element | Gelatin per side | XOC Dye Coverage | XOC Dye Location | % Crossover | Speed | Contrast | Dmax | Dmin | Dye Stain | % Dryer |
|---|---|---|---|---|---|---|---|---|---|---|
| 12E | 19.4 | 0.55 | LEL | 16 | 80 | 2.2 | 3.5 | 0.30 | 0.02 | 60 |
| 13E | 19.4 | 1.1 | LEL | 10 | 69 | 1.9 | 3.5 | 0.31 | 0.02 | 60 |
| 14E | 19.4 | 2.2 | LEL | 5 | 56 | 1.6 | 3.5 | 0.28 | 0.03 | 60 |
| 11C | 19.4 | 0 | — | 25 | 100 | 2.4 | 3.6 | 0.30 | 0.02 | 60 |

Element 1C fully satisfied radiographic element requirements, except that the percent crossover was unacceptably high. High crossover results in unsharp images. Speed was assigned a relative value of 100 for purposes of comparison. Maximum density was in the desired 3.0–4.0 range. Minimum density was 0.27. Element 1C traversed 80 percent of the guide rollers before fully drying. Dye stain was low, only 0.04.

In Elements 2C–4C the addition of conventional crossover control layers (CCL) containing Dye XOC-1 increased the total gelatin per side well above 35 mg/dm$^2$. Crossover was reduced to less than 15% and, at higher dye concentrations, to less than 10%. However, the higher levels of gelatin prevented the elements from being completely dried. Hence, the elements emerged from the processor with marks from all of the guide rollers. To use these elements a longer drying cycle would be required. Also, dye stain increased from 0.04 to 0.06. There was some speed loss attributable reducing crossover. Contrast, Dmin and Dmax remained acceptable.

None of the Elements in Table I exhibited wet pressure sensitivity. That is, there was enough hydrophilic colloid in the emulsion layers to avoid local variations in density attributable to guide roller pressure. From examinations of varied element constructions it was apparent that if the increase of 16.3 mg/dm$^2$ gelatin produced by addition of the CCL of Elements 2C–4C were compensated by removing a like amount of gelatin from the emulsion layer, the resulting elements would exhibit severe wet pressure sensitivity-variations in density attributable to guide roller pressure.

In Elements 5C–7C incorporation of the Dye XOC-1 in the emulsion layers (EL) did not reduce crossover as well as placing the crossover dye in a separate underlying layer. Speed was significantly reduced, particularly at the higher crossover dye concentrations. Contrast, Dmin, Dmax and dye stain were all fully acceptable. The elements required from 80 to 90 percent of the dryer to be fully dried.

In Elements 8E–10E incorporation of the Dye XOC-1 in the lower emulsion layer (LEL) coated nearest the support while leaving this dye out of the upper emulsion layer (UEL) coated farthest from the support, produced superior performance. Crossover reduction was comparable to that obtained by coating a separate crossover control layer (CCL) and better than that observed when the dye mixed in a single emulsion layer per side. Speed was higher than that realized when Dye XOC-1 was mixed in a single emulsion layer per side. Contrast, Dmax and Dmin were all fully acceptable. Dye stain was only 0.04, better than that observed using separate crossover control layers. Only 80% of the dryer was required. That is, the samples were fully dry after passing over only 80 percent of the guide rollers. This demonstrated that the Example elements could be processed in less than 45 seconds and deliver superior photographic properties.

Referring to Table II and comparing Table I, when the gelatin per side was reduced to 19.4 mg/dm$^2$, it is apparent that the performance of Elements 12E to 14E were comparable to that of Elements 8E to 10E, respectively. The same advantages were realized. The only disadvantage of lowering the gelatin level per side shows up in Table II as a slightly elevated minimum density. Elements 12E to 14E also showed some wet pressure sensitivity (minimum density non-uniformities), but not enough to interfere with obtaining a useful radiographic image.

The invention has been described in detail with particular reference to preferred embodiments thereof, but it will be understood that variations and modifications can be effected within the spirit and scope of the invention.

What is claimed is:

1. A radiographic element comprised of a film support having first and second major surfaces and capable of transmitting radiation to which the radiographic element is responsive and, coated on each of the major surfaces, processing solution permeable hydrophilic colloid layers which are fully forehardened including at least one emulsion comprised of silver halide grains coated at a coverage capable of providing an overall radiographic element maximum density on processing in the range of from 3 to 4, a spectral sensitizing dye adsorbed by the silver halide grains, and a particulate dye (a) capable of absorbing radiation to which the silver halide grains are responsive, (b) present in an amount sufficient to reduce crossover to less than 15 percent, and (c) capable of being substantially decolorized during processing, wherein from 19 to 33 mg/dm$^2$ of hydrophilic colloid is coated on each of the major surfaces of the support, first and second of the hydrophilic colloid layers are coated on each major surface of the support with the first layers located nearer the support than the second layers, the second layers contain (a) silver halide grains accounting for from 30 to 70 percent of the total weight of the second layers, including tabular grains having a thickness of less than 0.3 μm which have an average aspect ratio of greater than 5 and accounting for greater than 50 percent of total grain projected area within the second layers, and (b) from 20 to 80 percent of the total silver forming the silver halide grains within the radiographic element, the first layers contain (a) the dye particles and (b) from 20 to 80 percent of the total silver forming the silver halide grains within the radiographic element, and the dye particles and the silver halide grains together account for from 30 to 70 percent of the total weight of each of the first layers.

2. A radiographic element according to claim 1 wherein the particulate dye is present as particles capable of reducing crossover to less than 10 percent.

3. A radiographic element according to claim 1 wherein the tabular grains having an average thickness of at least 0.1 μm.

4. A radiographic element according to claim 1 wherein the tabular grains having an average aspect ratio of greater than 8 and account for at least 70 percent of total grain projected area.

5. A radiographic element according to claim 1 wherein the hydrophilic colloid is coated on each of the major surfaces of the support at a coverage of from 25 to 33 $mg/dm^2$.

6. A radiographic element according to claim 5 wherein the hydrophilic colloid is coated on each of the major surfaces of the support at a coverage of from 30 to 33 $mg/dm^2$.

7. A radiographic element according to claim 1 wherein silver halide grains account for from 40 to 60 percent of the total weight of the second layers.

8. A radiographic element according to claim 1 wherein silver halide grains in the first layers account for from 30 to 70 percent of the silver halide grains within the radiographic element.

9. A radiographic element according to claim 1 wherein the dye particles and silver halide grains in the first emulsion layers account for 40 to 60 percent of the total weight of the first layers.

10. A radiographic element according to claim 1 wherein the radiographic element can be processed by the following processing cycle:

| | |
|---|---|
| development | 11.1 seconds at 40° C. |
| fixing | 9.4 seconds at 30° C. |
| washing | 7.6 seconds at room temperature |
| drying | 12.2 seconds at 67.5° C. |

employing a hydroquinone-pyrazolidinone developer.

* * * * *